US009067126B2

(12) United States Patent
Lucero

(10) Patent No.: US 9,067,126 B2
(45) Date of Patent: Jun. 30, 2015

(54) CUE EASY HOLD GLOVE

(71) Applicant: Marco Lucero, Jessup, MD (US)

(72) Inventor: Marco Lucero, Jessup, MD (US)

( * ) Notice: Subject to any disclaimer, the term of this patent is extended or adjusted under 35 U.S.C. 154(b) by 104 days.

(21) Appl. No.: 13/987,763

(22) Filed: Aug. 30, 2013

(65) Prior Publication Data

US 2015/0065262 A1 Mar. 5, 2015

(51) Int. Cl.
*A63D 15/00* (2006.01)
*A63D 15/10* (2006.01)

(52) U.S. Cl.
CPC ..... *A63D 15/105* (2013.01)

(58) Field of Classification Search
CPC ... A63D 15/105; A63D 15/00; A63D 15/006; A63B 69/00; A63B 71/146; A63B 71/148; A41D 19/0151
USPC ..... 473/44, 43, 2, 1; 2/161 A, 169, 163, 2/161.1, 21
See application file for complete search history.

(56) References Cited

U.S. PATENT DOCUMENTS

| | | | | | |
|---|---|---|---|---|---|
| 242,877 | A | * | 6/1881 | Bryant | 473/43 |
| 570,459 | A | * | 11/1896 | Cronin | 473/43 |
| 953,167 | A | * | 3/1910 | Furey | 473/43 |
| 1,149,834 | A | * | 8/1915 | James | 473/43 |
| 1,362,461 | A | * | 12/1920 | Anast | 2/21 |
| 1,483,595 | A | * | 2/1924 | Read | 473/205 |
| 3,544,111 | A | * | 12/1970 | Kluber et al. | 473/43 |
| D243,292 | S | * | 2/1977 | Koehler | D29/113 |
| 4,025,962 | A | * | 5/1977 | Hartung | 473/43 |
| 4,064,563 | A | * | 12/1977 | Stokes | 473/43 |
| 4,461,043 | A | * | 7/1984 | Lomedico | 473/43 |
| 4,573,220 | A | * | 3/1986 | Baker | 2/161.1 |
| D553,301 | S | * | 10/2007 | Van Buren | D29/117.1 |
| 2007/0079421 | A1 | * | 4/2007 | Davis | 2/163 |
| 2009/0025120 | A1 | * | 1/2009 | Vestling | 2/161.1 |

* cited by examiner

*Primary Examiner* — Mitra Aryanpour

(57) ABSTRACT

This invention is a Cue easy hold glove to be worn by cue sports players while engaging the game of cue sports. It is of a wearable material and has stalls for the thumb and the index finger, extends in a semi circular pattern to point on the wrist and extends along a line parallel the fore arm to a point below the wrist, held down with a band.

3 Claims, 3 Drawing Sheets

CUE EASY HOLD GLOVE

FIELD OF INVENTION

This invention, cue easy hold glove will be primarily classified under various North American Industry Classification System codes 339920: Sporting and Athletic Goods manufacturing 423910: Sporting and Recreational goods and Supplies Merchant Wholesalers 451110: Sporting Goods Stores 532292: Sporting Goods Rental

BACKGROUND OF THE INVENTION

My invention pertains to a device for use in increasing players' efficiency in Cue sports. There are three major subdivisions of games within Cue Sports, they include Carom Billiards: This refers to games played on tables without pockets, typically ten feet in length including among others Balkline and Straight Rail, Cushion Caroms, Three Cushion Billiards, Artistic Billiards and Four Ball Pool: which refers to a number of pocket billiards games generally played on six pocket tables of seven, eight foot length including among others Eight Ball (apparently the world's most widely played Cue Sports), Nine Ball, Ten Ball, Straight Pool, One Pocket and Bank Pool Snooker and or English Billiards: which refer to games played on a billiards table with six pockets and has a dimension of approximately 12 feet by 6 feet.

Though rules of play vary for the various Cue Sports, the objects of Cue Sports usually are to strike a ball (usually called a cue ball) with the end of a carefully shaped stick (usually called the cue stick) to a certain precision to achieve desired results.

For any Cue Sports player to achieve the desired precision, he or she has to master the act of balance, aiming and striking.

In all my years as a Cue Sports player, inability of most players to properly balance the Cue stick (usually placed over and between the thumb and the index finger with all the remaining fingers resting solidly on a surface) has been the main reason why they fail to achieve cue Sports success.

Therefore it is my firm belief that this invention will help people be better players by eliminating the problems of achieving the balance necessary to make a good aim and strike.

BRIEF SUMMARY OF THE INVENTION

This invention is a cue easy hold glove, it is a glove with a wrist brace and digits cover for the thumb and the index finger. On top of the glove located in between the thumb and the index finger is a channel (cue channel) which consists of a semicircular rigid member that positions and retains the cue stick having such allowance to account for unrestricted strike at a cue ball. The glove helps keep the channel in form while a player is engaged in a cue Sports.

This device is very important because it assists the player to keep the Cue stick steady while player makes a strike. This device is so easy to use. This device assists players make a good strike each time. This device is important because it will aid in the rapid development of the game (a lot of people stay away from cue Sports due to constraints arising from proper balance of the cue stick). This device can be used by adults, male or female as well as kids. This device is important because it is inexpensive to buy and maintain.

DESCRIPTION OF THE PREFERRED EMBODIMENT

Figure 1:
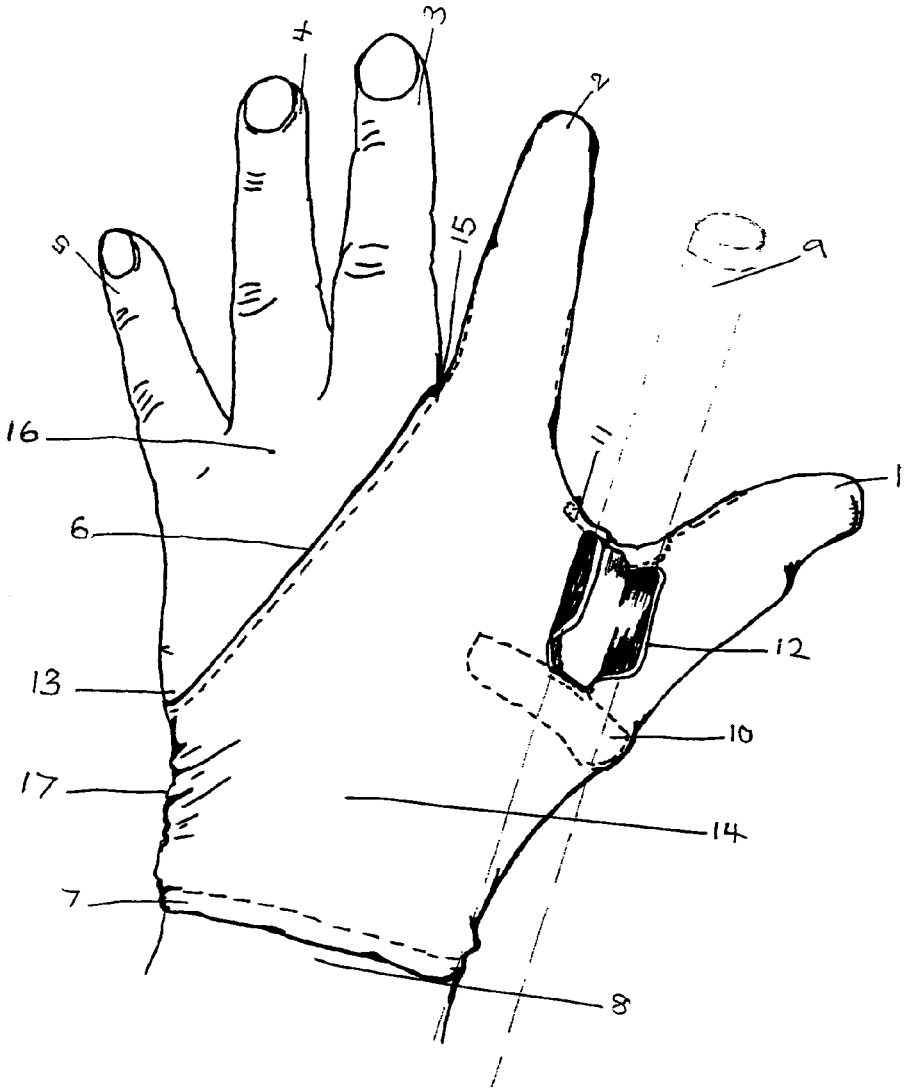
FIG. 1 is a top view of the cue easy hold glove in an imagery left hand showing the Cue holder and a Cue stick in position.
Figure 2:
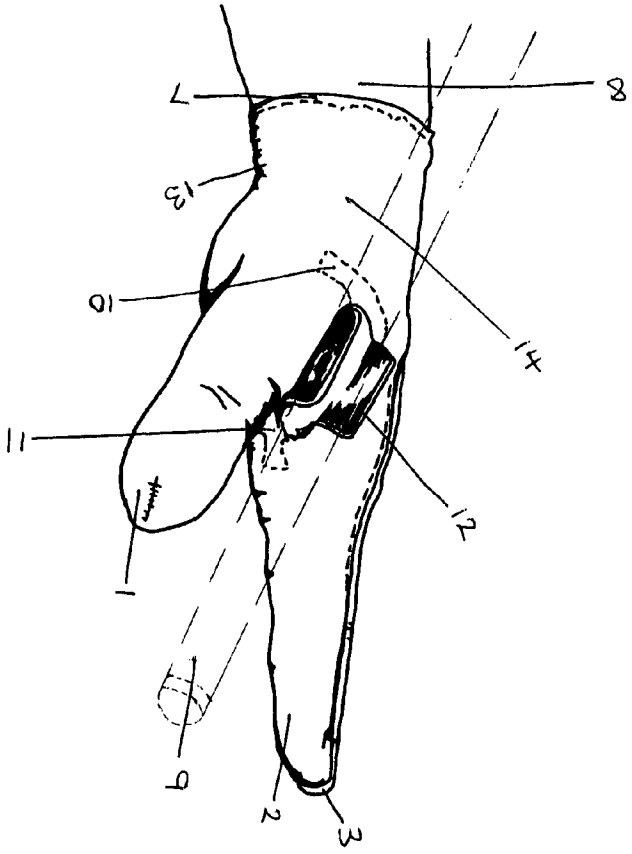
FIG. 2 is a sectional view of the cue easy hold glove in an imagery left hand showing the Cue Holder and a Cue stick in position on a flat surface.
Figure 3:
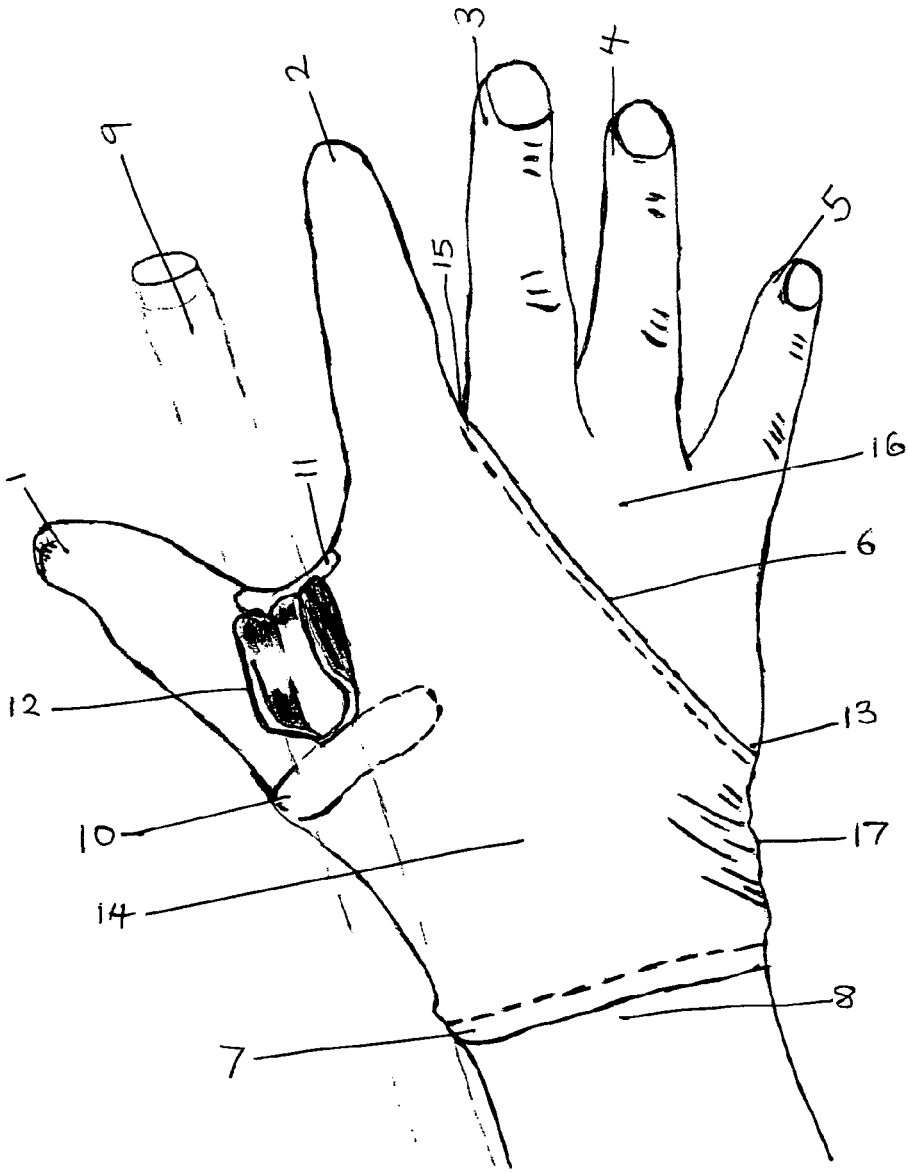
FIG. 3 is a top view of the cue easy hold glove in an imagery right hand showing the Cue holder and a Cue stick in position.

With reference now to the drawings FIG. 1, FIG. 2 and FIG. 3, there is a shown cue easy hold glove of preferably an elastic, flexible material such as of natural or synthetic fabric or the like, comprising of stalls to receive and sheath the thumb and index finger with an attached channel for a cue stick.

In FIG. 1, the glove to be worn on the left hand for right handed players has a stall 1 to receive and sheath the thumb; a stall 2 to receive and sheath the index finger, the second finger 3 is exposed and not covered by the glove as is the third finger 4 and the fourth finger 5. The side edge 6 of the back of the glove extends from the second web space 15 in a semi circular form to a point adjacent to the wrist 13 and midway of the hand exposing a considerable area on the back of the hand 16, the second finger 3, the third finger 4 and fourth finger 5. The glove extends from the wrist parallel with the fore arm to a point 17 where it is braced with a band 7 exposing the fore arm 8. The Cue stick 9 is placed in the channel 12 which consists of a semi circular rigid member that positions and retains the Cue stick, having such allowance to account for unrestricted strike at a Cue ball. The channel 12 is held down firmly by tie down component 10 to the back and another tie down component 11 to the front, and each component though visible for the purposes of the full description is however achieved with the use of invisible stitches and or a combination of methods so as not to affect the aesthetic nature of the finished product. The glove also covers mid way on the back of the hand 14 to make it comfortable and secure for the wearer.

In FIG. 2 the glove has a stall to receive and sheath the thumb 1, a stall to receive and sheath the index finger and the tip of the second finger 3 is exposed. The glove appears to be in an imagery hand that rests on an imaginary surface and the glove neatly fits the left hand with much of the back of the hand covered midway 14 to a line that covers the wrist 13 and extends further down the arm and firmly held down by a band 7 exposing the fore arm 8. The Cue stick 9 appears to be in the channel 12 which is tied down to the back with a tie down component 10 and another tie down component 11 to the front to firmly secure the channel.

In FIG. 3 the glove to be worn on the right hand for left handed players has a stall 1 to receive and sheath the thumb, a stall 2 to receive and sheath the index finger, the second finger 3 is exposed and not covered by the glove as is the third finger 4 and the fourth finger 5. The side edge 6 of the back of the glove extends from the second web space 15 in a semi circular form to a point adjacent to the wrist 13 and midway of the hand exposing a considerable area on the back of the hand 16, the second finger 3, the third finger 4 and fourth finger 5. The glove extends from the wrist parallel with the fore arm to a point 17 where it is braced with a band 7 exposing the fore arm 8. The Cue stick 9 is placed in the channel 12 which consists of a semi circular rigid member that positions and retains the Cue stick, having such allowance to account for unrestricted strike at a Cue ball. The channel 12 is held down firmly by tie down component 10 to the back and another tie down component 11 to the front, and each component though visible for the purposes of the full description is however achieved with the use of invisible stitches and or a combination of methods so as not to affect the aesthetic nature of the finished product. The glove also covers mid way on the back of the hand 14 to make it comfortable and secure for the wearer.

The cuts on the glove and the cue channel can be modified in various ways from that illustrated and other means may be used than that described for holding the glove and the cue channel on a wearers hand. The glove and the cue channel can be made of a plurality of pieces of material but the material should be consistent, for the glove, the material should be flexible, elastic or of a material that makes it wearable without causing discomfort and the cue channel should be made out of a consistent material to form a rigid member with a degree of allowance and elasticity to account for unrestricted strike at a cue ball.

Wearing the CUE EASY HOLD GLOVE eliminates the need for applying powder to the first web space and all its resultant mess. It keeps and retains the cue in firm position giving the wearer more leverage to aim and strike.

A modification of the invention through color, size, construction, material or any other aesthetic manner but still having same principles of this invention are within the scope of this invention and as such is regarded as the invention.

I claim:

1. A cue easy hold glove for use by cue sports player, comprising:

a glove covering a portion of the palm and back of the player's hand and secured around the wrist of the player;

the glove further including a pair of stalls for receiving and sheathing the thumb and index finger of the player's hand;

a cue channel securely attached between the pair of stalls in a manner to adequately position and retain the cue stick to allow for unrestricted strike at a cue ball.

2. The cue easy hold glove as set forth in claim 1, wherein the glove covering is formed of a material selected from the group consisting of: flexible material, elastic material, cloth material or combination thereof.

3. The cue easy hold glove as set forth in claim 1, wherein the channel is formed of a semi-circular, rigid material which aids in positioning and retaining a cue stick having such allowance and elasticity to account for unrestricted strike at a cue ball.

* * * * *